United States Patent [19]

Pinkerton

[11] 4,008,003

[45] Feb. 15, 1977

[54] VALVELESS POSITIVE DISPLACEMENT PUMP

[76] Inventor: Harry E. Pinkerton, Bridle Path Lane, Mill Neck, N.Y. 11765

[22] Filed: June 27, 1975

[21] Appl. No.: 590,896

[52] U.S. Cl. ..... 417/250; 137/99; 417/251; 417/492

[51] Int. Cl.[2] ..... G05D 11/035

[58] Field of Search ..... 137/99; 417/250, 251, 417/492, 499, 500; 222/134, 136, 137

[56] References Cited

UNITED STATES PATENTS

| | | | |
|---|---|---|---|
| 2,034,964 | 3/1936 | Thompson | 417/492 X |
| 2,887,094 | 5/1959 | Krukemeier | 137/99 UX |
| 3,091,186 | 5/1963 | Hofmeister | 417/250 |
| 3,168,872 | 2/1965 | Pinkerton | 417/492 |
| 3,495,610 | 2/1970 | Van Aken, Jr. | 137/99 |

FOREIGN PATENTS OR APPLICATIONS

| | | | |
|---|---|---|---|
| 325,720 | 6/1969 | Sweden | 137/99 |

*Primary Examiner*—Robert G. Nilson
*Attorney, Agent, or Firm*—Nolte and Nolte

[57] ABSTRACT

There is disclosed a valveless positive displacement pump having a cylinder with a piston reciprocal and rotatable therein and dividing the cylinder into two working chambers. Inlet and outlet ports communicate with the working chambers and the piston has ducts at each end which are sequentially brought into register with the ports as the piston reciprocates and rotates in the cylinder to produce a pumping action in each chamber. A piston rod is secured to the piston and extends from one end of the piston through one of the working chambers to the outside of the cylinder and is connected to a drive mechanism. In certain embodiments of the invention illustrated, means are provided to equalize the output from the two chambers and in other embodiments the fact that the effective volumes of the chambers are unequal is utilized to achieve proportional joining, mixing or separation of fluids handled by the pump.

11 Claims, 5 Drawing Figures

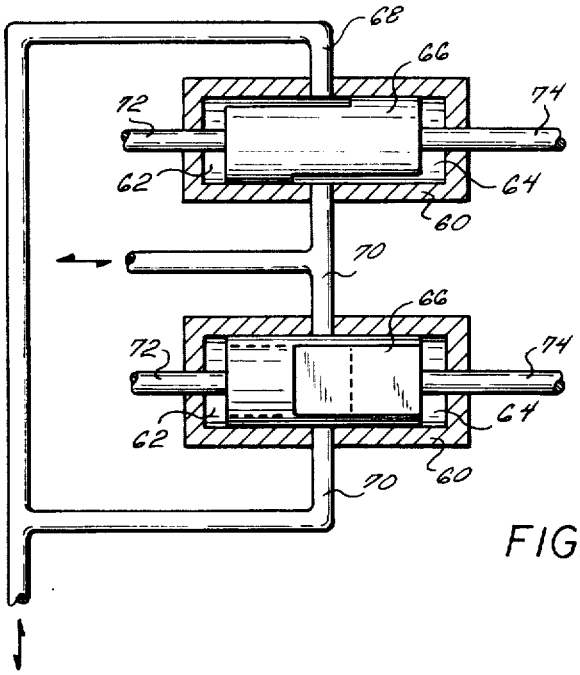
FIG. 3
FIG. 4
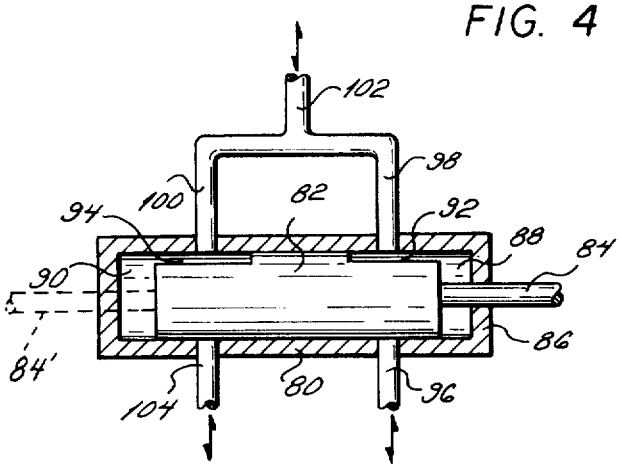
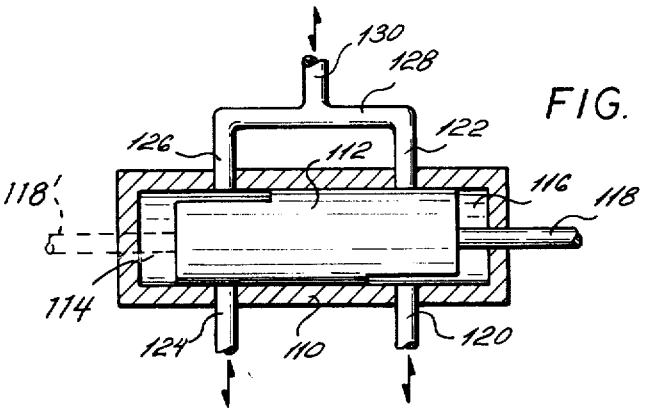
FIG. 5

VALVELESS POSITIVE DISPLACEMENT PUMP

BACKGROUND OF THE INVENTION

This invention is concerned with positive displacement pumps and is concerned with pumps of the general kind described in U.S. Pat. No. 3,168,872, issued Feb. 9, 1965 to Pinkerton. The basic pump of that patent comprises a cylinder, a piston forming, with the cylinder, a working chamber and mounted for rotation and reciprocating sliding movement in the cylinder. A drive effective to provide that rotary and reciprocatory movement is provided, that drive being connected to a piston rod secured to the piston. Inlet and outlet ports are provided for the admission and exit of fluid from the cylinder and the piston has a duct which sequentially provides communication between the inlet port and the working chamber and between the outlet port and the working chamber.

The aforementioned patent illustrates a double monoplex version of the pump and a duplex version of the pump besides the single monoplex version described hereabove. In each of the double monoplex and duplex pumps the piston has ducts at each end and divides the cylinder into two working chambers, one at each end of the piston. In the double monoplex pump, each chamber has an inlet and an outlet port and the arrangement is such that as one chamber expands during reciprocal movement of the piston, the duct at the corresponding end of the piston registers with the inlet port to that chamber while the other chamber reduces in volume and the other duct registers with the outlet port from that other chamber. In this way there is achieved the pumping action of two single pumps, i.e. there is achieved a double monoplex action.

The duplex pump of the aforementioned patent has a single inlet port and a single outlet port and the arrangement is such that the ducts connect the chamber of the cylinder which is expanding with the inlet port and the chamber of which the volume is being reduced with the outlet port.

The point to be made concerning the double monoplex and duplex pump described in the patent is that the patentee failed to ascribe any significance to the fact that the presence of the piston rod is one of the chambers is effective to make the volume swept by the piston in that chamber lesser than that swept by the piston in the other of those chambers so that the volumes of the two working chambers is appreciably different. The shortcomings resulting from this characteristic are apparent.

The failure to attribute significance to this characteristic or even to recognize it is not an aberration to which only the inventor of the pump of the aforementioned patent is subject. Reference is made to the disclosure of Arp's U.S. Pat. Nos. 3,530,872 and 3,530,873 and to Malburg's U.S. Pat. No. 2,203,832, each of which illustrates a double acting piston/cylinder type pump of which the difference in volumes of the working chambers at each side of the piston is present but in each one of which the failure to recognize this characteristic has introduced a distinct error.

In Arp, U.S. Pat. No. 3,530,872, there is shown a double acting piston/cylinder unit for handling oxygen in a respirator system and the piston of that unit is ganged to a single acting piston cylinder for handling the air or other fluid to be mixed with the oxygen. Referring specifically to FIG. 2 of that patent, it will be apparent that the quantity of oxygen moved from one side to the other of the double acting piston as that piston moves from right to left will be in excess of that which can be accommodated on the other side of the piston and, as a result, that excess oxygen must pass to the outlet and, of course, will not be mixed with the second fluid.

In Arp's U.S. Pat. No. 3,530,873 a pair of double acting piston/cylinder units are illustrated, one of which meters the oxygen supply and the other of which meters the supply of another gas, such as air, the pistons of the two units being ganged by a common piston rod. Referring to FIG. 3 of the drawings of that patent, it is clear that the volume of oxygen delivered to the outlet line is greater in left to right movement of the piston than it is in right to left movement where exactly the opposite is true of the second fluid. As such, considerable errors are introduced in the proportions of the fluids in the mixture produced by that system.

In Malburg's U.S. Pat. No. 2,203,832, there is illustrated a system which purports accurately to proportion and mix two liquids, one of which two liquids, one of which is water and the other of which is embalming fluid. Since Malburg is concerned with a treatment of cadavers, the strictest accuracy is probably not necessary, nonetheless, this is the stated aim of the patentee and it is clear from a consideration of FIG. 1 of Malburg's patent that substantial error must occur in the proportions of the two fluids mixed. Considering that figure, it is to be observed that the amount of embalming fluid to be mixed with water during right to left movement of the pistons will exceed that amount delivered to be so mixed on left to right movement of the pistons. Since there is a by-pass between opposite sides of the piston/cylinder from which the embalming fluid is being delivered and since an additional mixing piston/cylinder device is provided, this error may be lessened to acceptable limits considering that the resulting mixture is utilized only on cadavers. Nonetheless, the error is present and it is clear that its presence was not recognized by Malburg.

According to one aspect of the present invention, double monoplex and duplex pumps of the kind generally described in Pinkerton's U.S. Pat. No. 3,168,872 are provided with means for equalizing the volume swept by the piston in the two chambers of the cylinder in such pumps. According to another aspect of the present invention, utilization is made of the characteristic of having different volumes of the chambers at each side of the piston to achieve proportional mixing, joining or separating of fluids handled by the pump.

BRIEF DESCRIPTION OF THE DRAWINGS

Embodiments of this invention are illustrated, schematically, in the accompanying drawings, in which:

FIG. 3 shows a multiple duplex pump;

FIG. 4 shows a pump arranged for proportionally mixing two fluids or for proportional sampling of a fluid stream; and FIG. 5 shows a pump which can be used for proportionally margining fluid streams or for proportionally splitting a single fluid stream.

DESCRIPTION OF THE PREFERRED EMBODIMENTS

Figure 1:
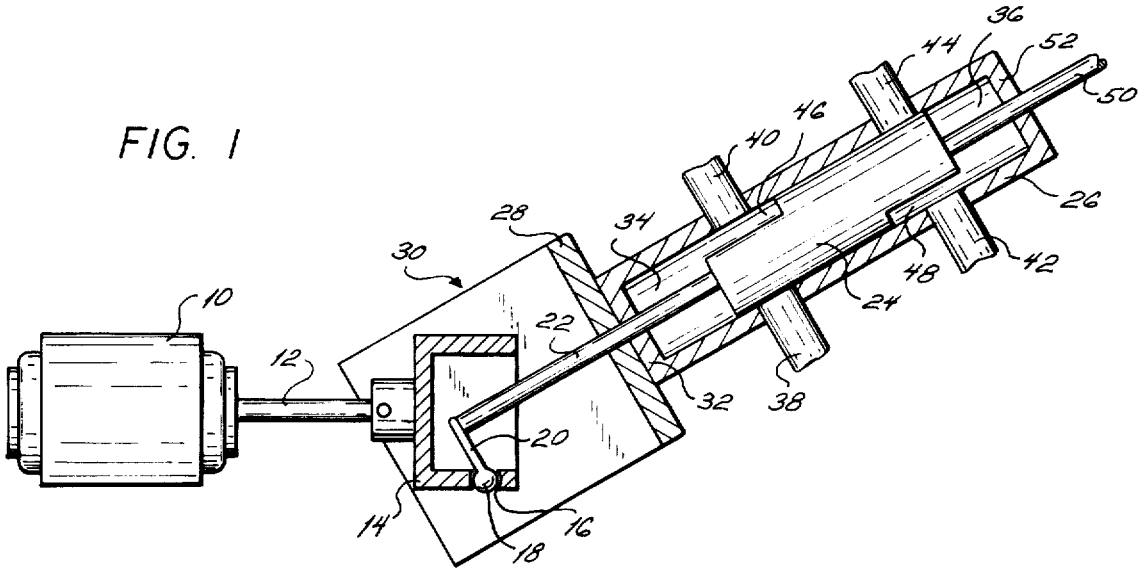
FIG. 1 is a plan view of a pump of this invention, drawn partly in elevation and partly in cross-section.

The pump illustrated in FIG. 1 is a double monoplex pump, but is will be appreciated from what follows that the drive mechanism is equally applicable to the various other types of pumps illustrated in the drawings.

The arrangement of FIG. 1 comprises a rotary power source 10 to the shaft 12 of which is secured a collar 14. Formed in collar 14 is a socket 16 of a universal ball and socket joint of which the ball 18 is slidably mounted on an arm 20 projecting laterally from, and secured to a piston rod 22. The piston rod 22 is secured to a piston 24 which is reciprocably and rotatably mounted in cylinder 26. The cylinder 26 is secured to a vertical plate 28 of an L-shaped bracket, indicated generally at 30, and which is mounted for pivotal movement about a vertical axis so that the angle between the axis of the cylinder and drive shaft 12 of the motor is variable.

Piston rod 22 extends through an opening of plate 28 and through end wall 32 of cylinder 26, and the piston 24 is effective to divide the cylinder into a working chamber 34 at one side of the piston and a working chamber 36 at the other side of the piston.

Disposed to communicate with the chamber 34 are ports 38 and 40 and similar ports 42 and 44 communicate with chamber 36. Each end of the piston is provided with a duct, the duct 46 at that end of the piston defining, in part, the chamber 34 being effective to place the ports 38 and 40 in communication with chamber 34 and duct 48 at the other end of the piston serving the same purpose with the ports 42 and 44.

To this point, the arrangement is similar to that described in U.S. Pat. No. 3,168,872 and the operation of the arrangement as double monoplex pump is fully described in that patent. It will readily be appreciated that by increasing the angle between the cylinder and the drive shaft 12 the stroke of the piston may be increased and that when the cylinder is moved into axial alignment with shaft 12, piston stroke is reduced to zero while moving the cylinder to the other side of the axis of shaft 12 will result in the pumping being reversed.

Since the particular operation of the pump is described in detail in the aforementioned patent, a minutely detailed description will not be included in this application, in the interest of brevity. Suffice it to say that the pump of this application thus far described is subject to the various modifications described in that patent and the disclosure of that patent is incorporated herein by this specific reference.

According to this invention, the piston is provided with an idler piston rod 50 which projects from that side of the piston opposite to the side from which piston rod 32 extends and is guided in an appropriately sealed opening in end wall 52 of the cylinder. The piston rod 50 most desirably is of similar cross section to piston rod 22 and by the adoption of this arrangement the volume of chambers 34 and 36 swept by the piston are made equal so that the capacities of the two pumps constituted by the piston and the chambers 34 and 36 are rendered equal. It will be understood that in the absence of idler piston rod 50, the volume of chamber 36 swept by the piston would be greater than that swept by the piston in chamber 34 by an amount equal to the cross sectional area of the piston rod 22 multiplied by the stroke of the piston.

Thus, by the adoption of this relatively simple expedient, the fluctuations in delivery present in the pump as described in the U.S. Pat. No. 3,168,872 but seemingly not recognized in that patent, would be eradicated.

Figure 2:
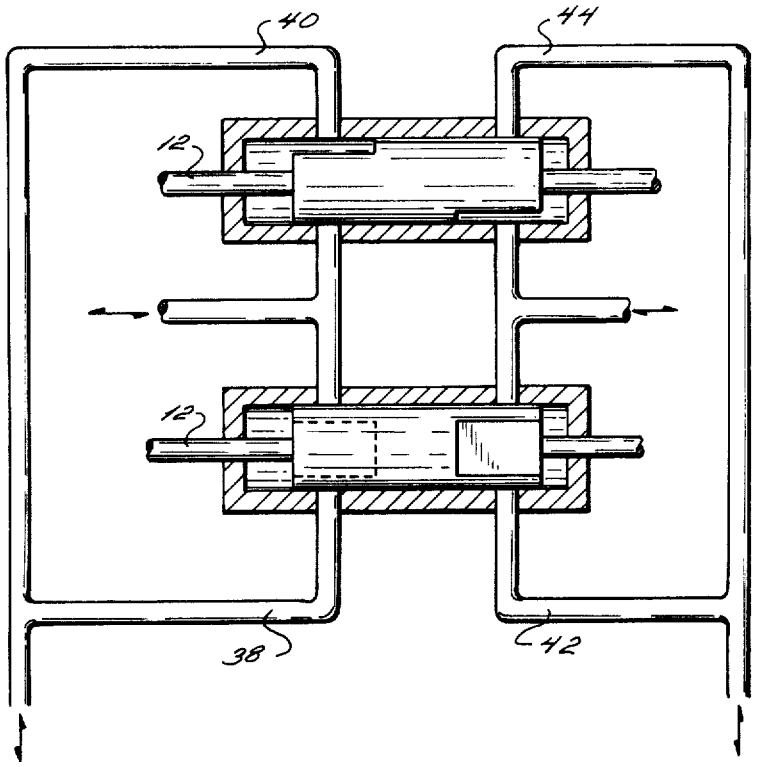
FIG. 2 shows a multiple, double monoplex pump according to this invention.

The arrangement in FIG. 2 shows two pumps of substantially the same form as FIG. 1, those pumps being arranged to provide what is in effect a rectified multiphase flow transferance characteristic. With the particular connections shown in FIG. 2, it will be appreciated that twin single phase rectified pump outputs are obtained since the ducts of the pistons of the two pumps are 90° phase shifted from each other. However, it is to be understood that be selecting the relative angular positions of the ducts, by varying the number of pump utilized in a system and the manner in which the pumps are connected, a considerable range of different outputs are available.

Most desirably, and as described in the aforementioned patent, the two pumps in FIG. 2 are mechanically ganged so that in a single adjustment the stroke of the pumps can be changed as required. Again, of course, it is to be appreciated that by shifting the axis of the cylinder to either side of the drive shaft axis, the pumps are fully reversible and it is of course further to be appreciated that with such reversal, what was originally the inlet port to the chambers will then become the outlet port and vice-versa.

In FIG. 3 there are shown two duplex pumps. The drive to those pumps is substantially similar to that of the pump illustrated in FIG. 1 and as such is not illustrated in this figure.

The duplex pumps each comprise a cylinder 60 divided into pumping chambers 62 and 64 by a piston 66 and a pair of ports 68 and 70 communicate with the chambers of the cylinder.

The rotating and reciprocating movement of the piston within the cylinder provides a duplex pumping action in which, depending upon the angular disposition of the cylinder relative to the axis of the drive shaft, the ports 68 and 70 act as either inlets or outlets. The pumping action is described fully in U.S. Pat. No. 3,168,872 and for this reason a detailed description is not repeated herein.

In the structure of FIG. 3, each piston has a piston rod 72 which is connected to a drive mechanism and each piston has an idler piston 74 projecting from that end of the piston opposite to the end from which piston rod 72 projects, piston rod 74 being sealed at the adjacent end wall of the cylinder. The presence of piston rod 74 of course equalizers the volumes of the chambers 62 and 64 swept by the piston so that the delivery errors attendant upon the stucture as described in the aforementioned patent are substantially eradicated.

With the pipe work as shown in the drawing, the output will in effect by full wave two phase rectified but as with the arrangement of FIG. 3, various output characteristics can be achieved by selecting different numbers of pumps, the relative angular position of the piston ports and the connections made between the ports.

In FIG. 4 of the drawings, there is illustrated a structure for the proportional mixing of two fluids A and B, and in that structure advantage is taken of the fact that the chambers to either end of the piston have different volumes swept by the piston in its reciprocating movement due, of course, to the presence of the drive piston rod in one of those chambers.

Specifically, in that figure, cylinder 80 has a piston 82 reciprocably and rotatably mounted therein, the piston having a piston rod 84 projecting through an end wall 86 of the cylinder and being connected to a drive mechanism which may take the form of that illustrated in FIG. 1.

The piston is effective to divide the cylinder into a first working chamber 88 and a second working chamber 90 and the piston has ducts 92 and 94 at opposite ends thereof. An inlet port 96 is formed in the cylinder wall to communicate with working chamber 88 and an outlet port 98 also communicates with chamber 88 and leads to port 100 which constitutes an inlet to working chamber 90. In the connection between ports 98 and 100 is formed for a second fluid and an outlet port 104 communicates with chamber 90.

It is to be appreciated that the presence of piston rod 84 in chamber 88 reduces the effective volume of chamber 88 swept by the piston to be lesser than the volume of chamber 90 swept by that piston by an amount directly related to the cross-sectional area of the piston rod and the stroke of the piston. It is upon the recognition of this characteristic that the accurate mixing of two fluids is obtained according to this invention.

It will be appreciated that during left to right movement of the piston a first fluid in chamber 88 will be forced through port 98 to port 100 the expanding chamber 90, but since chamber 90 is of greater volume than chamber 88 the second fluid will be drawn into chamber 90 through inlet 102 and thorough mixing of the two fluids will occur prior to admission of the two fluids into chamber 90.

Upon commencement of right to left movement of the piston, the duct 92 will be brought into communication with port 96, of course, port 98 will be obturated and the first fluid will flow into chamber 88. At the same time, port 100 into chamber 90 will be obturated and the duct 94 will be brought into register with port 104 and the mixed fluids in chamber 90 will pass through the outlet constituted by that port.

It is to be appreciated that the structure of FIG. 4 is one which will result in an accurate mixture of the first and second fluids and, since mixing occurs in the connection between ports 98 and 100, that the structure can be utilized to mix a second fluid which would have a deletereous effect on the cylinder and piston since, of course, that second fluid would reach chamber 90 only after being mixed with the first fluid.

It is further to be appreciated that any particular proportion of fluids, can be obtained and if it is required that the second fluid entering through inlet 102 be so small, relative to the quantity of first fluid, that the rod 84 would be required to occupy so small a space as to be less sturdy than necessary, then an idler piston rod 84' (indicated in chain line) could be secured at the left hand end of the piston, that idler piston rod having an appropriate slightly different cross-section than piston rod 84.

As explained hereinbefore, the pump is reversible in mode of operation and it will therefore be appreciated that mode reversal of the embodiment of FIG. 4 will result in a means for continuous proportional sampling from a main stream flow. That is to say, with the embodiment of FIG. 4 operating in the sampling mode, port 104 would become the inlet port, port 96 would become the main stream outlet port and port 102 would become the sample stream outlet port.

The pump of FIG. 5, depending upon the connections to be made upon the angular position of the cylinder, can be used either for proportionally joining two streams, without mixing within the pump, or for proportionally splitting a stream.

The pump of FIG. 5 comprises a cylinder 110 divided by a piston 112 into working chambers 114 and 116, the piston having a piston rod 118 to a drive which conveniently takes the form of that illustrated in FIG. 1. Formed in the side walls of the cylinder for sequential communication with chamber 116 are ports 120 and 122 and similarly, ports 124 and 126 are formed for sequential communication with working chamber 114. Ports 122 and 126 are connected by a conduit 128 and a branch 130 communicates with that conduit.

To join streams with the pump of FIG. 5, the ports 120 and 124 are connected to constitute inlets for first and second fluids respectively, and connection 130 is constituted as an outlet for a joined stream constituted by the two fluids.

It will be appreciated that the presence of piston rod 118 in working chamber 116 reduces the effective volume of that chamber 116 so that a lesser amount of the first fluid would enter the pump through 120 than the amount of the second fluid which would enter chamber 114 through port 124. Thus, the resultant joined stream at 130 would comprise the sum of the two different fluid streams.

By the selection of piston rod size, the proportions of the fluids can be varied as desired and if it is required that the two fluids be united in equal amounts, then a dummy of idler piston rod (as indicated in chain line at 118') can be secured to the left hand side of the piston to project through the adjacent end wall, in this way equalizing the swept volumes of chambers 114 and 116.

To achieve the splitting of a single stream into two streams by the utilization of the apparatus of FIG. 5, the inlet of the stream would be made at port 130 and as will be apparent the ports 120 and 124 would constitute outlets from the working chambers with which they are associated. Again, the amount of fluid in the stream issuing from port 120 would be lesser than that issuing from port 124 by an amount directly relates to the cross-sectional area of the piston rod 118 and the stroke of piston 112. Again, if it is required to divide the stream into equal parts, then an idler piston rod can be secured to the left hand side of the piston to project through the adjacent end wall of the cylinder.

It must be recognized that the several embodiments of the invention here illustrated are only schematic versions and are subject to various modifications. For example, the drive to the piston can be applied either as illustrated herein or by other means as, for example, as illustrated in FIG. 23 of the aforementioned U.S. Pat. No. 3,168,872. Additionally, rod and gland scavanging means may be provided as also described in the aforementioned patent.

What is claimed is:

1. Apparatus for proportionally mixing two fluids comprising a cylinder, a piston reciprocal and rotatable in said cylinder and dividing said cylinder into two working chambers, an inlet port for a first fluid to one of said chambers, an outlet port from said one chamber, and an inlet port to the other of said chambers, a conduit between said outlet port of said one chamber and the inlet port of the other of said chambers, an outlet port from said other chamber for mixed fluids, said piston having duct means sequentially registering with said ports, and conduit means connecting with said ports to form a fluid circuit, a drive piston rod secured to said piston and projecting from one end thereof to the exterior of the cylinder and connected to drive means for producing reciprocating and rotating movement of said piston, said piston rod being effective to reduce the volume of said one chamber through which it extends to be lesser than that of the other chamber, and second conduit means connected to said circuit and connectable to a supply of a second fluid whereby said second fluid is drawn into the circuit to make up for the difference in volumes in said chambers.

2. Apparatus as claimed in claim 1 wherein said second conduit means is connected to said conduit between said one chamber and said chamber whereby mixing of said fluids occurs in said conduit.

3. Apparatus as claimed in claim 2 wherein an idler piston rod is secured to an end of the piston opposite said end from which said drive piston rod extends, said idler piston rod projecting to the outside of said cylinder and being of different cross-sectional area than said drive piston.

4. Apparatus as claimed in claim 1 wherein an idler piston rod is secured to an end of the piston opposite said end from which said drive piston rod extends, said idler piston rod projecting to the outside of said cylinder and being of different cross-sectional area than said drive piston.

5. Apparatus for extracting a proportion of a fluid flow comprising a cylinder, a piston reciprocal and rotatable in said cylinder and dividing said cylinder into two working chambers, an inlet port for a fluid stream to one of said chambers, an outlet port from said one chamber, and an inlet port to the other of said chambers, a conduit between said outlet port of said one chamber and the inlet port of the other of said chambers, an outlet port from said other chamber, said piston having duct means sequentially registering with said ports, and conduit means connecting with said ports to form a fluid circuit, a drive piston rod secured to said piston and projecting from one end thereof to the exterior of the cylinder and connected to drive means for producing reciprocating and rotating movement of said piston, said piston rod being effective to reduce the volume of said other chamber through which it extends to be lesser than that of said one chamber, and second conduit means connected to said circuit and constituting an outlet from said circuit for a part of said fluid stream whereby excess fluid is extracted to accommodate the difference in volumes in said chambers.

6. Apparatus for handling fluids comprising a cylinder, a piston reciprocable and rotatable in said cylinder and dividing the cylinder into two working chambers, one at each end of the piston, two inlet ports, one to each of said chambers, and two outlets ports, one from each of said chambers, a drive piston rod secured to said piston and extending through said one chamber to the exterior of the cylinder and connected to drive means for producing reciprocating and rotating movement of said piston within said cylinder, and piston having ducts sequentially brought into communication with said ports to establish a pumping action in each chamber and wherein a first conduit connects said chambers in series and extends between an inlet port and an outlet port and wherein a branch conduit communicates with said first conduit between said inlet and said outlet port.

7. Apparatus as claimed in claim 6 wherein said first conduit connects an outlet from said one chamber and an inlet to said other chamber, said inlet to said one chamber being connectable to a supply of a first fluid and said branch conduit being connectable to a supply of a second fluid whereby said first and said second fluids are mixed in said one circuit.

8. Apparatus as claimed in claim 7 wherein an idler piston rod extends from that end of the piston opposite to that end from which said drive piston rod extends, said idler rod being of different cross section than said drive piston rod.

9. Apparatus as claimed in claim 6 wherein said first conduit connects an outlet from said other chamber with an inlet to said one chamber and wherein said branch conduit constitutes an outlet from said first conduit whereby an excess of fluid transported from said other chamber over that amount of fluid required to fill said one chamber is removed through said branch conduit.

10. Apparatus as claimed in claim 9 wherein an idler piston rod extends from that end of the piston opposite to that end from which said drive piston rod extends, said idler rod being of different cross section than said drive piston rod.

11. Apparatus as claimed in claim 6 wherein an idler piston rod extends from that end of the piston opposite to that end from which said drive piston rod extends, said idler piston rod being of different cross section than said drive piston rod.

* * * * *